US008714173B2

(12) United States Patent
Rosen

(10) Patent No.: US 8,714,173 B2
(45) Date of Patent: May 6, 2014

(54) WALKING AID WITH SUPPORT

(76) Inventor: Howard Rosen, Oxnard, CA (US)

( * ) Notice: Subject to any disclaimer, the term of this patent is extended or adjusted under 35 U.S.C. 154(b) by 0 days.

(21) Appl. No.: 13/396,201

(22) Filed: Feb. 14, 2012

(65) Prior Publication Data

US 2013/0206195 A1 Aug. 15, 2013

(51) Int. Cl.
*A45B 9/04* (2006.01)
*A61H 3/02* (2006.01)

(52) U.S. Cl.
CPC ..... *A45B 9/04* (2013.01); *A61H 3/0277* (2013.01); *A61H 3/02* (2013.01)
USPC ..... 135/82; 135/79; 135/77

(58) Field of Classification Search
CPC ..... A45B 9/04; A61H 3/02; A61H 3/2088; A61H 3/0277
USPC ..... 135/65, 69–70, 77, 79–82, 84; 248/614–616, 188.9, 170–171
See application file for complete search history.

(56) References Cited

U.S. PATENT DOCUMENTS

| | | | | |
|---|---|---|---|---|
| 3,448,749 | A * | 6/1969 | Stark | 135/70 |
| 3,901,258 | A * | 8/1975 | Montgomery | 135/68 |
| 4,091,828 | A | 5/1978 | Jorgensen | |
| 4,811,750 | A * | 3/1989 | McAllister | 135/66 |
| 5,056,546 | A * | 10/1991 | Sharp | 135/68 |
| 5,755,245 | A | 5/1998 | Van Helvoort | |
| 6,192,908 | B1 * | 2/2001 | Smith | 135/66 |
| 6,651,684 | B2 | 11/2003 | Spitzer | |
| D531,399 | S * | 11/2006 | Olerud | D3/7 |
| 7,647,937 | B2 * | 1/2010 | Gordon | 135/65 |
| 8,371,320 | B1 * | 2/2013 | McKenna | 135/77 |
| 2005/0056739 | A1 * | 3/2005 | Koning et al. | 248/171 |
| 2011/0100404 | A1 * | 5/2011 | La Chimia | 135/77 |

FOREIGN PATENT DOCUMENTS

| | | | | |
|---|---|---|---|---|
| JP | 2000325119 | A * | 11/2000 | A45B 9/04 |
| JP | 2002065328 | A * | 3/2002 | A45B 9/04 |
| JP | 2005006699 | A * | 1/2005 | A45B 9/04 |
| JP | 2005130966 | A * | 5/2005 | A45B 9/04 |
| JP | 2005176983 | A * | 7/2005 | A45B 9/04 |
| JP | 2006090389 | A * | 4/2006 | |
| JP | 2007152078 | A * | 6/2007 | |

* cited by examiner

*Primary Examiner* — Winnie Yip
(74) *Attorney, Agent, or Firm* — Edwards Wildman Palmer LLP; Scott D. Wofsy; Brian S. Matross

(57) ABSTRACT

A walking aid for use on a support surface is provided. The walking aid includes an elongated member having an upper end and a lower end and defining an interior cavity and a longitudinal axis, a stopper coupled to the lower end of the elongated member, and a support apparatus for supporting the walking aid. The support apparatus is translatable through the stopper and the interior cavity to a retracted position within the stopper and interior cavity, and to an extended position projecting from the stopper. The support apparatus is also biased radially outward relative to the longitudinal axis, and configured to extend away from the longitudinal axis and contact the support surface in the extended position.

17 Claims, 2 Drawing Sheets

WALKING AID WITH SUPPORT

BACKGROUND OF THE INVENTION

1. Field of the Invention

The present invention relates to walking aids, and more particularly, to walking aids which utilize support devices for balance and support thereof.

2. Description of Related Art

Walking aids such as canes, crutches, walking sticks, or other devices which include at least one elongated member are commonly used to assist ambulatory individuals who have pain issues, trouble keeping balance, and/or other disabilities which impair their ability to walk, rise from a sitting position, sit from a standing position, or otherwise move normally. Walking aids help such individuals with these functions, which in turn can improve activity levels and help facilitate better social interaction. As walking aids which are simple, light weight, and non-intrusive (e.g. having a small footprint or periphery) are generally desired, they are typically built with a narrow construction. Otherwise, the walking aid may itself become an obstacle if it is too bulky, heavy, or obtrusive. As a result, walking aids tend to have a fairly high center of gravity and are prone to tipping over, a situation which can pose significant problems or risk for an individual relying on easy access to the walking aid from a sitting or standing position. For example, the individual might be unable to bend over to pick up the walking aid, or may risk a fall and further injury. The individual may also wish to have both hands free with easy access to the walking aid in certain situations where there are no places to lean the walking aid, such as in stores or while waiting in line.

A number of designs have been developed to help support the walking aid, such as, for example, those disclosed in U.S. Pat. No. 6,651,684 to Spitzer; U.S. Pat. No. 5,755,245 to Van Helvoort; and U.S. Pat. No. 4,091,828 to Jorgensen. These references disclose walking canes with various types of stand mechanisms and associated activation mechanisms. While such conventional methods and systems have generally been considered satisfactory for their intended purpose, there remains a continuing need in the art for simple, light-weight, non-intrusive devices for assisting individuals with the issues discussed above.

SUMMARY OF THE INVENTION

The subject invention is directed to a new and useful walking aid for use on a support surface. The walking aid includes an elongated member having an upper end and a lower end and defining an interior cavity and a longitudinal axis; a stopper coupled to the lower end of the elongated member; and a support apparatus which is translatable through the stopper and interior cavity to a retracted position within the stopper and interior cavity, and to an extended position projecting from the stopper. The support apparatus is biased radially outward relative to the longitudinal axis, and configured to extend away from the longitudinal axis and contact the support surface in the extended position. In the extended position, the support apparatus supports the walking aid in a free standing vertical position.

In certain embodiments, the walking aid includes a drive member coupled to the support apparatus, and a lever coupled to the drive member and projecting radially outward therefrom. The drive member is operatively disposed within the interior cavity of the elongated member and longitudinally translatable relative thereto. The lever is operable to longitudinally translate the drive member to move the support apparatus to the retracted and extended positions.

In certain embodiments, the lever is itself longitudinally translatable with the drive member. The elongated member preferably defines a slot along a length thereof leading to the interior cavity. The lever projects outward from the drive member through the slot, and external of an outer wall of the elongated member. In this manner, the lever is translatable along the slot by a user to move the support apparatus to the retracted and extended positions.

In certain embodiments, the support apparatus includes a plurality of support members configured to engage the support surface in the extended position. The support members each include a lower section which is preferably substantially straight in the retracted position and defines convex inner and concave outer surfaces in the extended position. The lower sections are preferably made of a flexible spring material to achieve their outward bias, and configured to support the walking aid on the support surface in the vertical free standing position when they are disposed in the extended position. The support members extend through respective channels defined by the stopper, and are at least partially housed in and supported by the channels when disposed in the retracted position.

In accordance with certain embodiments, the support members include three prongs circumferentially spaced about the stopper. The circumferentially spaced prongs have lower ends which are preferably separated from one another by no more than 3.5 inches when the prongs are disposed in the extended position. Each prong includes a lower tip for engaging the support surface.

According to one aspect of the invention, the drive member includes a tube having a top end and a bottom end, the plurality of support members are mounted to the bottom end of the tube, and the lever, drive member, and support members, are separable from the elongated member.

According to another aspect of the invention, the stopper of the walking aid has a bottom diameter no more than 1.5 inches.

According to another aspect of the invention, the elongated member is a cane.

According to yet another aspect of the invention, the stopper and elongated member are elevated relative to the support surface when the walking aid is disposed in the vertical free standing position.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
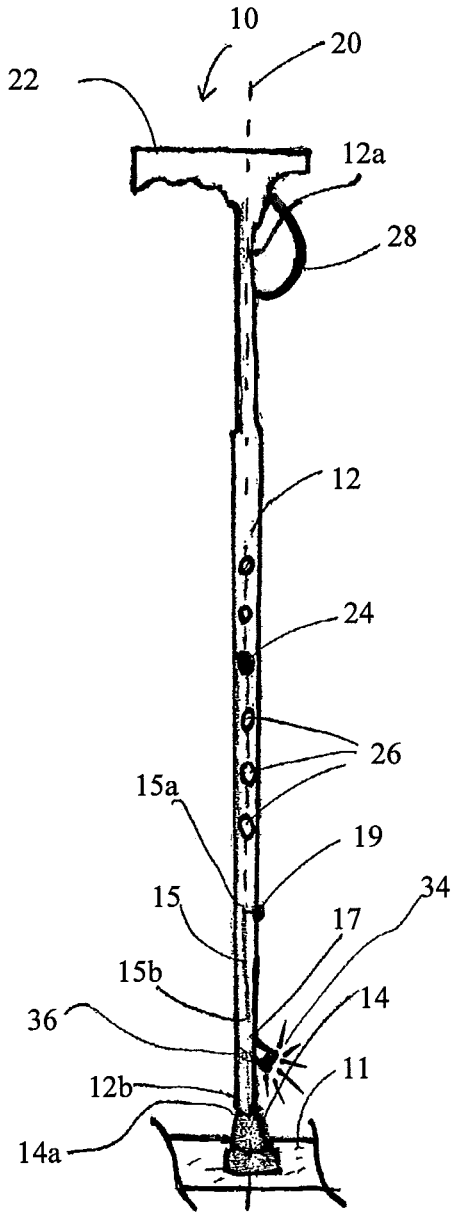
FIG. 1 is a side view of an exemplary embodiment of a walking aid constructed in accordance with the present invention, showing the walking aid vertically oriented with the support apparatus in a retracted position.

Reference will now be made to the drawings wherein like reference numerals identify similar structural features or aspects of the subject invention. For purposes of explanation and illustration, and not limitation, the exemplary embodiment of the walking aid in accordance with the invention is shown in FIG. 1 and is designated generally by reference character 10.

Turning now to FIGS. 1-5, the walking aid 10 is used on a support surface 11, and includes an elongated member 12, a stopper 14, and a support apparatus 16. The elongated member 12 has an upper end 12*a* and a lower end 12*b*, and defines an interior cavity 18 (FIG. 4) and a longitudinal axis 20. At the upper end 12*a*, a handle 22 is provided for grasping and utilizing the walking aid 10. Toward the lower end 12*b*, the elongated member 12 defines a slot 15 through an outer wall 17 thereof. The slot 15 has an upper end 15*a* and a lower end 15*b*, and extends through the outer wall 17 to the interior cavity 18. The slot 15 of the elongated member 12 receivably engages a lever 19 attached to the support apparatus 16. The interior cavity 18 (FIG. 4) of the elongated member 12 extends from the lower end 12*b* toward the upper end 12*a* thereof, and houses an upper portion 16*a* (FIG. 3) of the support apparatus 16.

The elongated member 12 may be formed in varying shapes, such as straight, rounded, a combination thereof, or in other shapes known in the art, but is preferably formed in a shape which minimizes its footprint or outer periphery and minimizes bulkiness. The elongated member 12 may also be formed as one piece or as two or more pieces which slidably overlap one another to adjust the overall length thereof, such as, for example, via a depressible locking detent 24 which is receivably engaged in one of two or more holes 26 defined by the elongated member 12. The upper end 12*a* of the elongated member 12 may be provided with a strap 28 of leather or other material for hanging the walking aid 10 or for wrapping around a user's shoulder or arm during or after use.

The elongated member 12 may be constructed from a number of different materials, including, by way of example, metal, wood, bamboo, plastic, Lucite, polymer, or any other suitable material or recycled material known in the art, but is preferably formed from a lightweight material so as to minimize bulkiness. A reflective material which glows at night or in the dark may alternatively or additionally be provided, along with bright colors such as white, red, or aluminum to make the walking aid 10 easier to find outside or in a darkened room or hallway. Other colors such as black may be utilized. The handle 22 can be formed in various shapes from the same or different materials as the elongated member 12.

The stopper 14 is provided at the lower end 12*b* of the elongated member 12 and coupled thereto. The stopper 14 may be permanently fixed to the lower end 12*b* by any suitable means, or detachably coupled thereto, such as by a threaded engagement, interference fit, and the like. An upper lumen 30 (FIG. 5) is provided at an upper end 14*a* of the stopper 14. The upper lumen 30 is configured to receive the lower end 12*b* of the elongated member 12, whereby the upper lumen 30 of the stopper 14 is in open communication with the internal cavity 18. The stopper 14 also preferably defines three channels 32*a*, 32*b*, 32*c* and a bottom rib 33 at a lower end 14*b* thereof. The three channels 32*a*, 32*b*, 32*c* are in open communication with the upper lumen 30, and configured to support and guide a lower portion 16*b* of the support apparatus 16 as it is translated between retracted and extended positions. The bottom rib 33 is configured to contact the support surface 11 when the support apparatus 16 is in a retracted position as represented by FIG. 1. The stopper 14 may alternatively define one large lumen extending from its narrowed upper end 14*a* to its widened lower end 14*b*. The stopper 14 has a bottom diameter preferably no more than 1.5 inches, though other dimensions may be utilized.

The stopper 14 is preferably made from rubber or material temper foam, and may similarly be provided with reflective materials that glow at night and/or bright colors to aid with identification and visibility at floor level. The stopper 14 or lower end 12*b* of the elongated member 12 may be provided with a clip-on light 34 which is attached via a strap 36 or other attachment means. The clip-one light 34 may be battery powered, and activated or deactivated via a switch depending upon the longitudinal position of the support apparatus 20 relative to the elongated member 12.

Figure 2:
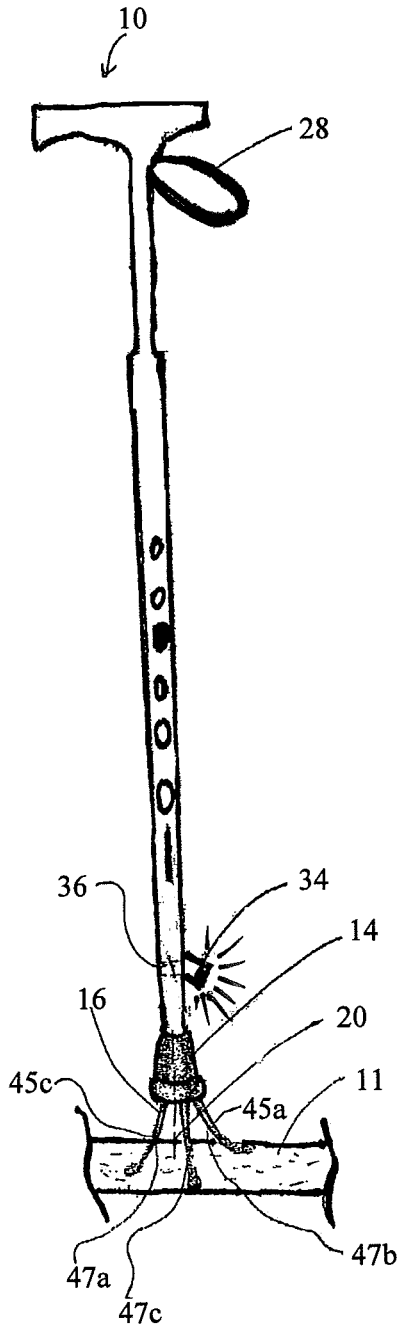
FIG. 2 is a side view of the walking aid of FIG. 1, showing the walking aid in a free standing vertical position with the support apparatus in an extended position.
Figure 3:
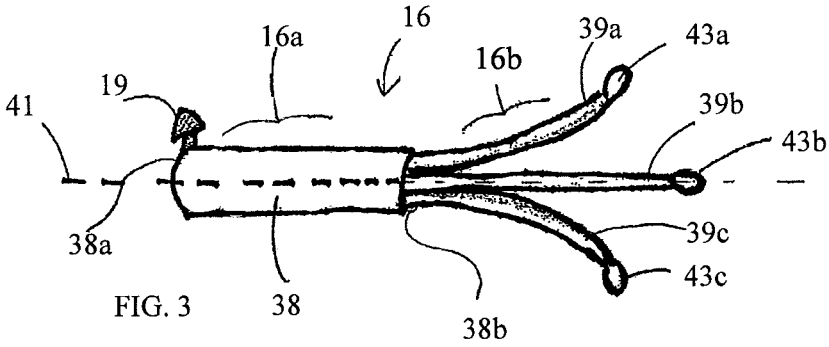
FIG. 3 is an enlarged view of the support apparatus and lever of FIG. 1.

The support apparatus 16 is translatable through the lumen 30 of the stopper 14 and the interior cavity 18 of the elongated member 12 to a retracted position within the stopper 14 and interior cavity 18 (FIG. 1), and to an extended position projecting from the stopper 14 (FIG. 2). As most clearly shown in FIG. 3, the support apparatus 16 preferably includes a drive member 38 having an upper end 38*a* and a lower end 38*b*, and three support members or prongs 39*a*, 39*b*, 39*c*. As shown, the lever 19 extends from the upper end 38*a* of the drive member 38, and the support members 39*a*, 39*b*, 39*c* extend from the lower end 38*b* of the drive member 38. The lever is preferably detachably connected to the drive member 38 so that it can be removed therefrom to allow for removal of the entire support apparatus 16 for replacement thereof or repairs thereto. The drive member 38 is formed in the shape of a tube, though it will be appreciated that other shapes may be utilized so long as the drive member 38 fits and is longitudinally translatable within the interior cavity 18 of the elongated member 12. For example, the drive member 38 may be formed very narrowly to reduce material costs and friction between the drive member 38 and the inner surface of the outer wall 17, and to facilitate removal of the support apparatus 16 from the elongated member 12. As shown in FIG. 3, the prongs 39*a*, 39*b*, 39*c* are preferably arranged circumferentially about the lower end 38*b* of the drive member, are preferably biased radially outward relative to the longitudinal axis 41 of the drive member 38, and extend outward away from the longitudinal axis 41 when unconstrained. The prongs 39*a*, 39*b*, 39*c* each have respective tips 43*a*, 43*b*, 43*c* which are configured to engage the support surface 11. The tips 43*a*, 43*b*, 43*c* may be blunted, and preferably curve slightly upwardly relative to the respective prongs to which they are attached in the extended position so to create additional contact with the support surface 11 and provide lateral support to the walking aid 10. The tips may alternatively 43*a*, 43*b*, 43*c* be tapered and downward pointing.

Figure 4:
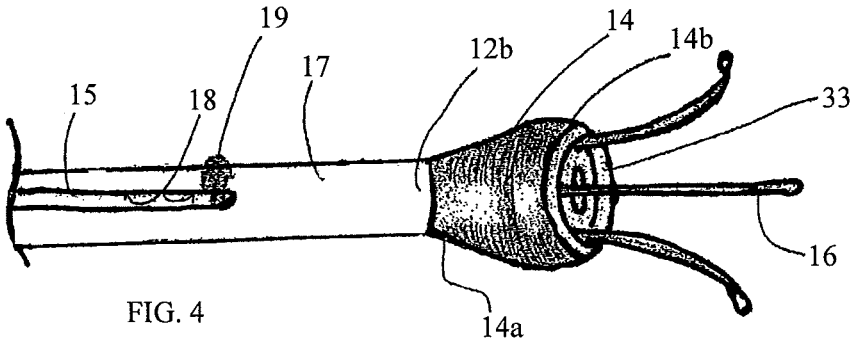
FIG. 4 is an enlarged view of the lower end of the elongated member, the stopper, the lower sections of the support apparatus, the lever, and the slot defined by the elongated member of the walking aid of FIG. 1.
Figure 5:
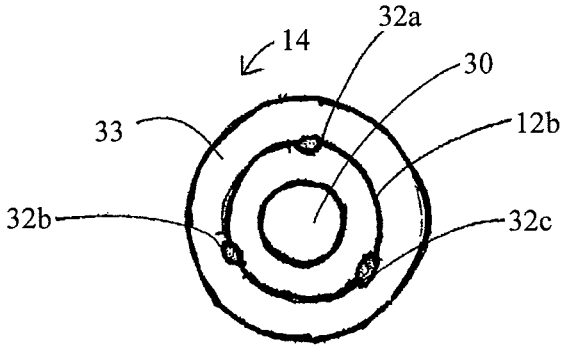
FIG. 5 is a cross-sectional view of the stopper of the walking aid of FIG. 1, showing the channels defined by the stopper which support and guide the support apparatus.

The support apparatus 16 is configured to be placed inside the elongated member 12 and stopper 14 as shown in FIG. 4. As shown, the lever 19 projects from the upper end 38*a* of the drive member 38, through the slot 15, and beyond the outer surface of the outer wall 17 of elongated member 12. The lever 19 is shown at the lower end 15*b* of the slot 15, which places the support apparatus 16 in an extended position with the prongs 39*a*, 39*b*, 39*c* extending through the upper lumen 30 of the stopper 14, and through the respective channels 39*a*, 39*b*, 39*c* at the lower end 14*b* of the stopper 14. FIG. 4 thus corresponds to the configuration of the walking aid in FIG. 2.

The drive member 38 is preferably made from metal or heavy plastic. The prongs 39*a*, 39*b*, 39*c* are made from a flexible metal or plastic, and preferably from a flexible spring material to achieve their outward bias away from the axis 41 of the drive member 38. The tips 43*a*, 43*b*, 43*c* are also preferably made from metal or heavy plastic, and are preferably coated with a layer of liquid red rubber to help keep the walking aid 10 in place and to help eliminate scratching surfaces in the vertical free standing position.

The operation of the walking aid 10 is straightforward. As alluded to above, in FIG. 1, the walking aid 10 is shown in a vertical orientation with the support apparatus in the retracted configuration. The lever 19 is situated at the upper end 15*a* of the slot 15. The prongs 39*a*, 39*b*, 39*c* are retracted within the interior cavity 18 of the elongated member 12 and the channels 32*a*, 32*b*, 32*c* of the stopper. The tips 43*a*, 43*b*, 43*c* of the prongs 39*a*, 39*b*, 39*c* are disposed within the bottom rib 33 of the stopper 14 above the support surface 11, and the walking aid 10 is vertically oriented with the bottom rib 33 of the stopper 14 contacting the support surface. It will be appreciated that in this configuration, the walking aid 10, like most other walking aids of similar proportions and dimensions, can easily be tipped over or fall over on its own, and is unlikely to be free standing, especially after some wear and tear on the stopper 14. The user utilizes the walking aid 10, which can be a cane, a crutch, or the like, by gripping the handle 22 with his or her hand if the walking aid 10 is configured as a cane, or by placing the handle 22 under his or her armpit if the walking aid 10 is configured as a crutch, and leaning on it while standing, walking, rising from a sitting position, or sitting from a standing position. If the user desires to leave the walking aid 10 and have two hands free, he or she simply slides the lever 19 downwardly along the slot 15 from the upper end 15*a* to the lower end 15*b*. The downward longitudinal translation of the lever 19 forces downward longitudinal translation of the drive member 16 relative to the elongated member 12, and of the prongs 39*a*, 39*b*, 39*c* relative to the stopper 14 and elongated member 12. When the lever 19 reaches the lower end 15*b* of the slot 15, the prongs 39*a*, 39*b*, 39*c* will be fully extended. This places the walking aid 10 in the vertically oriented free standing position of FIG. 2 with the tips 43*a*, 43*b*, 43*c* engaging the support surface 11, the prongs 39*a*, 39*b*, 39*c* curving away from the longitudinal axis 20 of the elongated member 12, and the bottom rib 33 of the stopper 14 elevated relative to the support surface 11.

As the prongs 39*a*, 39*b*, 39*c* have an outward bias, they define curves having concave surfaces 45*a*, 45*b*, 45*c* on their respective outer sides and convex surfaces 47*a*, 47*b*, 47*c* on their respective inner sides. The arcs of these prongs 39*a*, 39*b*, 39*c*, together with their circumferential spacing, creates a larger footprint, similar to that of a tri-pod, which provides improved lateral stability and better balance to the walking aid 10. The walking aid 10 can thus be left free standing with easy access thereto. It can be left next to where the user sits or sleeps without the walking aid 10 leaning on anything and without it being placed on the floor and necessitating subsequent retrieval. In the preferred embodiment, the circumferentially spaced prongs 39*a*, 39*b*, 39*c* have lower ends which are separated from one another by no more than 3.5 inches in the extended position.

It will be appreciated that the lever 19, drive member 38, and prongs 39*a*, 39*b*, 39*c* are separable from the elongated member 12 by detaching the lever 19 from the drive member 38, detaching the stopper 14 from the lower end 12 of the elongated member, and pulling the support apparatus 16 out of the elongated member 12 and stopper 14.

The methods and systems of the present invention, as described above and shown in the drawings, provide for a walking aid with superior properties including being configurable to a free standing vertical position, easy to use, lightweight, non-intrusive, and easy to make, repair, and identify.

While the apparatus and methods of the subject invention have been shown and described with reference to preferred embodiments, those skilled in the art will readily appreciate that changes and/or modifications may be made thereto without departing from the spirit and scope of the subject invention as claimed. For example, it will be appreciated that while specific, shapes, materials, dimensions, and proportions have been disclosed for an elongated member, stopper, and support apparatus, it will be appreciated that other shapes, materials, dimensions, and proportions may additionally or alternatively be utilized for an elongated member, stopper, and support apparatus. While a three pronged support apparatus having a cylindrical drive member has been disclosed, it will be appreciated that other types of support apparatuses may be utilized which are consistent with the spirit and scope of the invention, such as additional or less support members or prongs, different materials, and alternative shapes and biasing thereof

What is claimed is:

1. A walking aid for use on a support surface, comprising:

a) an elongated member having an upper end and a lower end, and defining an interior cavity, a longitudinal axis, and a slot in an outer wall thereof along the longitudinal axis, the slot in communication with the interior cavity;

b) a stopper coupled to the lower end of the elongated member, the stopper defining a plurality of circumferentially disposed channels in an interior portion thereof, and a rib extending beyond and radially outward of the plurality of circumferentially disposed channels; and c) a support apparatus for supporting the walking aid, the support apparatus translatable through the stopper and the interior cavity to a retracted position completely within the stopper and interior cavity and an extended position projecting from the stopper, the support apparatus biased radially outward relative to the longitudinal axis, and configured to extend away from the longitudinal axis and contact the support surface in the extended position and d) an actuation lever coupled to the support apparatus, extending radially outward through the slot, and longitudinally translatable along the slot, wherein the support apparatus includes three circumferentially disposed support members, and each support member is made from a flexible spring material configured to outwardly spring bias the support member relative to the longitudinal axis, and wherein the support members are mounted for translation through the plurality of channels and configured to be completely retracted within the stopper and interior cavity with the rib contacting the support surface in the retracted position, and to be extended out of the stopper such that the outward spring bias of the support members causes curvature of the support members and extension of the support members away from the longitudinal axis radially outward beyond the rib in the extended position.

2. A walking aid according to claim 1, further comprising:

e) a drive member operatively disposed within the interior cavity, and longitudinally translatable relative to the elongated member, wherein the actuation lever is adapted and configured to longitudinally translate the drive member within the interior cavity to translate the support apparatus to the retracted and extended positions in harmony with longitudinal translation of the actuation lever along the slot.

3. A walking aid according to claim 1, wherein the support members are configured to engage the support surface in the extended position.

4. A walking aid according to claim 3, wherein a lower section of each support member is substantially straight in the retracted position and curved in the extended position.

5. A walking aid according to claim 3, wherein the three support members extend through the plurality of channels adjacent a radially inner edge of the rim of the stopper.

6. A walking aid according to claim 5, wherein the circumferentially spaced support members each have a lower end, and the respective lower ends of the support members are separated from one another by no more than 3.5 inches in the extended position.

7. A walking aid according to claim 3, wherein each of the plurality of support members includes a lower tip for engaging the support surface.

8. A walking aid according to claim 7, wherein the tips of the elongated members are configured to be operatively disposed within the rim of the stopper in the retracted position.

9. A walking aid according to claim 3, wherein the drive member is a tube having a top end and a bottom end, and the plurality of support members are mounted to the bottom end of the tube.

10. A walking aid according to claim 3, wherein the stopper has a bottom diameter no more than 1.5 inches.

11. A walking aid according to claim 3, wherein the elongated member is a cane.

12. A walking aid according to claim 3, wherein each support member defines a concave surface in the extended position.

13. A walking aid according to claim 3, wherein the plurality of support members are configured to support the walking aid in a vertical free standing position in the extended position.

14. A walking aid according to claim 13, wherein the rim of the stopper and the elongated member are elevated relative to the support surface in the vertical free standing position.

15. A walking aid according to claim 1, wherein the interior portion of the stopper includes a bottom surface offset from a bottom surface of the rim, and the bottom surface of the interior portion defines an opening to each channel.

16. A walking aid for use on a support surface, comprising:

a) an elongated member having an upper end and a lower end, and defining an interior cavity and a longitudinal axis;

b) a stopper coupled to the lower end of the elongated member, the stopper defining a plurality of circumferentially disposed channels in an interior portion thereof, and a rib extending beyond and radially outward of the plurality of circumferentially disposed channels; and c) a support apparatus for supporting the walking aid, the support apparatus translatable through the stopper and the interior cavity to a retracted position completely within the stopper and interior cavity, and to an extended position projecting from the stopper, the support apparatus biased radially outward relative to the longitudinal axis, and configured to extend away from the longitudinal axis and contact the support surface in the extended position, wherein the support apparatus includes three circumferentially disposed support members, and each support member is made from a flexible spring material configured to outwardly spring bias the support member relative to the longitudinal axis, and wherein the support members are mounted for translation through the plurality of channels and configured to be completely retracted within the stopper and interior cavity with the rib contacting the support surface in the retracted position, and to be extended out of the stopper such that the outward spring bias of the support members causes curvature of the support members and extension of the support members away from the longitudinal axis radially outward beyond the rib in the extended position.

17. A walking aid according to claim 16, further comprising:

e) a drive member operatively disposed inside the interior cavity; and f) a lever coupled to and extending from the drive member, wherein the interior cavity is defined by the lower end of the elongated member, the elongated member defines a slot, and the lever extends through and is longitudinally translatable along the slot to move the support apparatus between the retracted and extended positions.

* * * * *